United States Patent [19]

Shrader

[11] 4,065,887

[45] Jan. 3, 1978

[54] SOAPSTONE SHARPENER

[76] Inventor: Thomas E. Shrader, Rte. 3, Box 658B, Bakersfield, Calif. 93307

[21] Appl. No.: 665,660

[22] Filed: Mar. 10, 1976

[51] Int. Cl.[2] ..... B24D 15/00

[52] U.S. Cl. ..... 51/358; 51/391

[58] Field of Search ..... 51/352, 354, 355, 358, 51/382, 386, 391–393, 388, 214, 211 R; 76/82, 82.1, 82.2; 30/189, 190, 296 A

[56] References Cited

U.S. PATENT DOCUMENTS

| | | | |
|---|---|---|---|
| 1,433,855 | 10/1922 | Skreberg | 51/211 R |
| 1,710,589 | 4/1929 | Pearson | 30/296 A X |
| 2,238,340 | 4/1941 | Poe | 51/386 X |
| 2,262,401 | 11/1941 | Meade | 51/354 |
| 2,559,273 | 7/1951 | Brinkley | 51/214 X |
| 2,795,043 | 6/1957 | Fleischer | 30/296 A X |
| 2,961,670 | 11/1960 | Frame | 30/189 X |
| 3,114,352 | 12/1963 | Mathisen | 51/391 X |
| 3,776,068 | 12/1973 | Pisciotta | 76/82 |

*Primary Examiner*—Harold D. Whitehead
*Assistant Examiner*—Nicholas P. Godici
*Attorney, Agent, or Firm*—Huebner & Worrel

[57] ABSTRACT

A soapstone sharpener for providing a fine marking edge on the stone, the sharpener being comprised of an elongated member having facing legs forming a V-shape in cross section and having abrasive material secured on the inner faces of the legs to form inner abrading surfaces of V-shaped cross section. The soapstone is rubbed on the abrasive material within the V-shaped cross section to form the soapstone so as to be complementary to the V and have a fine marking edge.

6 Claims, 8 Drawing Figures

SOAPSTONE SHARPENER

BACKGROUND OF THE INVENTION

In welding, prior to cutting with a welding torch, soapstone is generally used as a marking means to draw an appropriate thin line on the metal to be cut by an acetylene torch, for example. The soapstone is similarly used in other metal work for marking to indicate breaking and cutting lines, for example.

In order to mark the metal with a thin line, the soapstone, which normally comes in a rectangular prism form, is typically sharpened at one end to have a thin line edge. In the prior art this has been primarily done by rubbing one end, first one side and then the other, on an abrasive material until the thin line edge is formed. Such prior art sharpening is relatively slow and tedious. It is also difficult to obtain the desired thin line edge in such sharpening.

SUMMARY OF THE INVENTION

The present invention is a device which overcomes the prior art difficulties in sharpening soapstone.

It is an object of the invention to provide an improved soapstone sharpener.

It is another object of the invention to provide a soapstone sharpener with which the soapstone can be sharpened quickly and easily so as to have a thin straight line marking edge.

It is still another object of the invention to provide a soapstone sharpener to which abrading material can be secured adhesively, secured by clips, or by returned edges of the device.

It is a further object of the invention to provide a soapstone sharpener which may be secured to a welding striker so that both devices can be carried integrally.

It is a still further object of the invention to provide a soapstone sharpener which can be secured to an operator's belt by hanging means, such as a key ring or a snap hook.

It is another object of the invention to provide a soapstone sharpener which may be adapted to be clipped to an operator's belt or to a garment pocket.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes.

DESCRIPTION OF THE PREFERRED EMBODIMENTS

Figure 1:
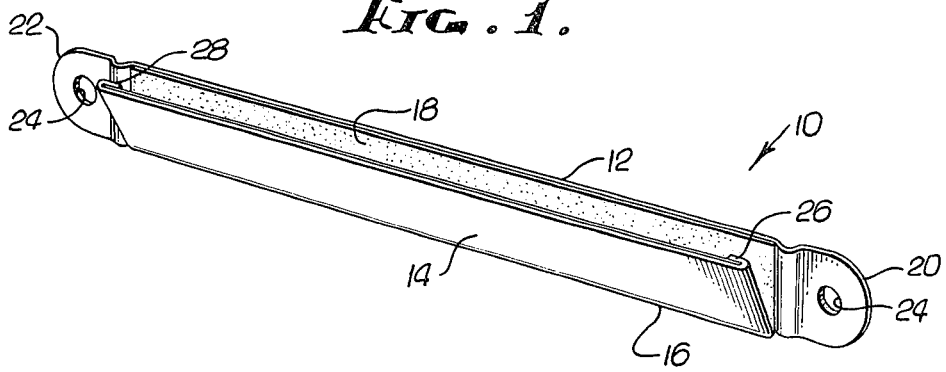
FIG. 1 is a perspective view of a soapstone sharpener according to the invention.

Referring again to the drawings, there is shown in FIG. 1 a soapstone sharpener 10 having elongated legs 12 and 14, joined along one elongated edge 16 so as to form a V in an end view.

The leg 12 has abrasive material 18 adhesively secured thereto. The abrasive material may be in the form of particles or sheets, such as emery paper or sandpaper. On the ends of the leg 12 are spacing bends to which tabs or ears 20 and 22 are joined, the ears having openings 24 extending therethrough for securing to a device, such as a welding striker. The leg 14 has the abrasive material secured thereto by returned edges 26 and 28 extending inwardly in the elongated direction. The abrasive material on the legs may be two single sheets or may be a continuous sheet forming a V along the inner surface of the edge 16. The material 18 may also be secured to the leg 14 adhesively.

Figure 2:
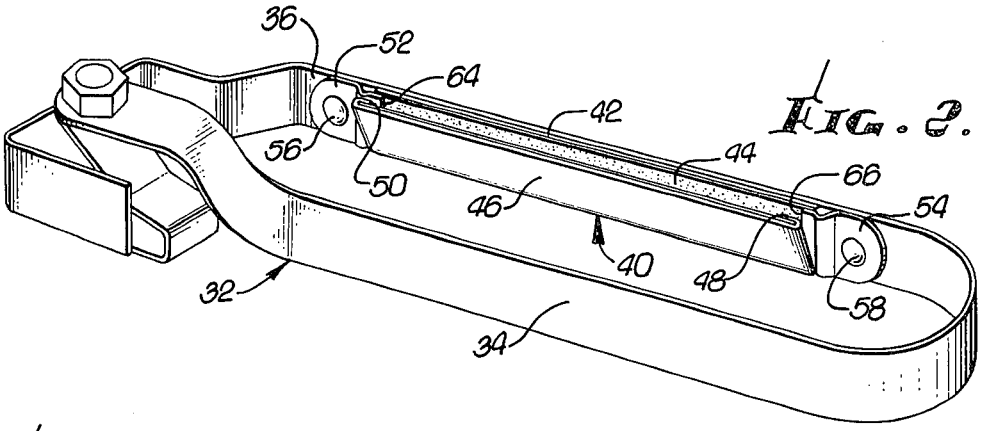
FIG. 2 is a perspective view of a welding striker to which a soapstone sharpener according to the invention is secured.

In FIG. 2 there is shown a welding striker, generally designated as 32, having an operating handle formed of the two elongated, spaced gripping arms 34 and 36.

The soapstone sharpener 40, shown in FIG. 2, is substantially the same as that shown in FIG. 1, except that it has no tabs extending from one of its legs 42. In this embodiment the leg 42 terminates in the elongated direction at the ends of the abrasive material 44 which may be adhesively secured to the leg 42. The other leg 46 has returned edges 48 and 50 for securing the abrasive material.

The sharpener 40 is secured to the striker arm 36 by means of clips 52 and 54 which are riveted at 56 and 58, respectively. At their inner ends the clips 52 and 54 have biasing clipping extensions 64 and 66 extending over the marginal ends of the legs 42 and also over the abrasive material 44 so as to secure the sharpener to the leg 36 of the striker and so as to secure the abrasive material to the leg 42.

Figure 3:
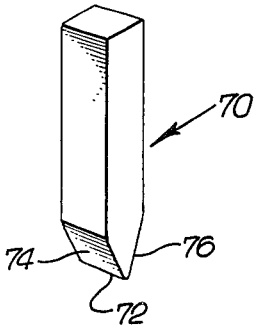
FIG. 3 is a perspective view of a sharpened soapstone.

In FIG. 3 there is shown a soapstone marker 70 having a sharpened thin line marking edge 72 from which extends two tapered sides 74 and 76. The form of the edge and the tapered sides is created by rubbing the lower end and the sides of the stone in the elongated direction in sharpeners, shown in FIG. 1 or FIG. 2, the shape of the stone becoming complementary to the V-shape of the sharpener. When the edge becomes blunt the soapstone is again sharpened, rubbing it in the elongated direction along the abrasive material so as to again create a thin line marking edge 72.

Figure 4:
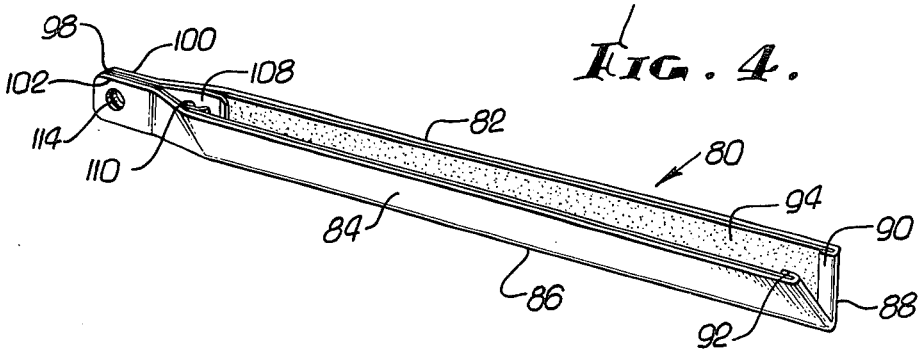
FIG. 4 is a perspective view of another embodiment of the invention.
Figure 5:
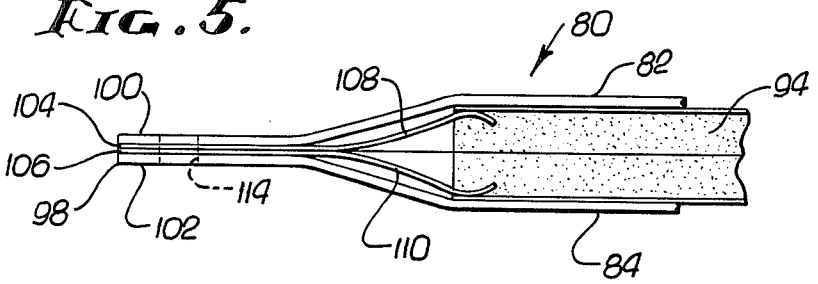
FIG. 5 is a fragmentary plan view of the embodiment shown in FIG. 4.

The soapstone sharpener 80, shown in FIGS. 4 and 5, is formed of two elongated legs 82 and 84 joined at an edge 86 to form a V in end view. At one end 88 of the sharpener, returned edges 90 and 92 secure the V-shaped abrasive material 94 within the device.

The other end 98 of the device has extensions 100 and 102 of the legs 82 and 84 bent so as to be proximate in parallel relationship. Crimped between the extensions 100 and 102 are ends 104 and 106 of spring biasing, clamping members 108 and 110, respectively, engaging the abrasive material so as to secure it against the legs 82 and 84. Adjacent the end 98 is an opening 114 which may be used to hang the sharpener on a snap hook or key ring, for example.

Figure 6:
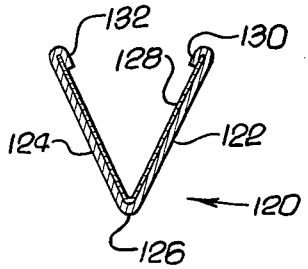
FIG. 6 is a fragmentary cross-sectional view of another variation of the invention.

In FIG. 6 there is shown a cross-sectional end view of a soapstone sharpener 120 formed of elongated legs 122 and 124 joined at a lower edge 126 to form a V-shaped cross section. In this embodiment a single sheet 128 of abrasive material is held in place by returned or folded edges 130 and 132 which extend inwardly in the short direction toward the edge 126 and extend in the elongated direction substantially coextensively with the legs 122 and 124. The abrasive material may be either snapped in under the edges 130 and 132 or may be inserted through their openings and moved into position in the elongated direction.

Figure 7:
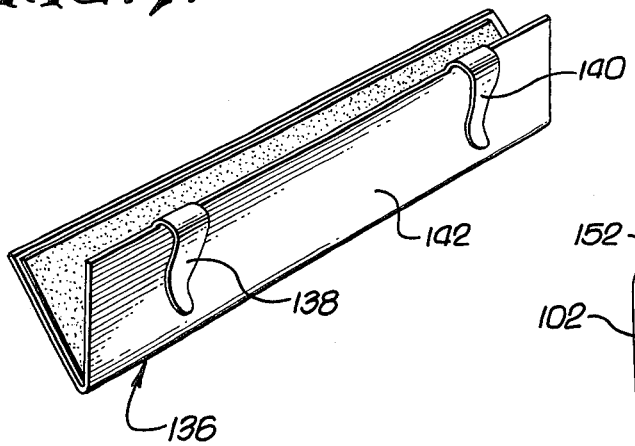
FIG. 7 is a perspective view of an embodiment of the invention which is adapted to be clipped on to thin sheet material.

In FIG. 7 the V-shaped sharpener 136 has two clips 138 and 140 folded outwardly on the leg 142 so as to be in clipping engagement therewith. This sharpener may be clipped on to a striker, as shown in FIG. 2, with the clips extending over the exterior of the leg 36 or may be clipped to any sheet material, such as may be found in the side of a tool box or in an operator's belt.

Figure 8:
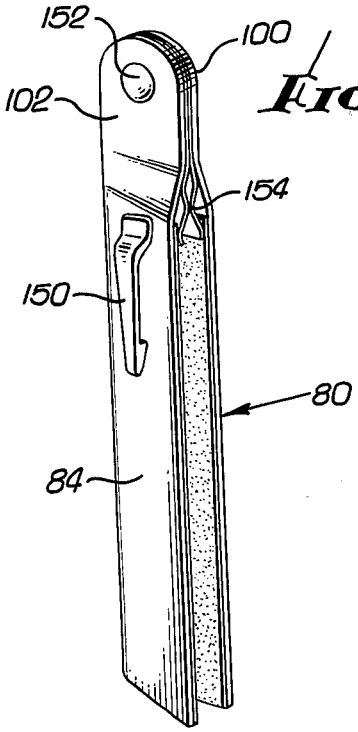
FIG. 8 is a still further embodiment of the invention which is adapted to be clipped on to thin sheet material.

In FIG. 8 the soapstone sharpener 80, shown in FIGS. 4 and 5, is varied by having a clip 150 attached to the leg 84. This embodiment may be carried in a pocket, on a belt, or may be secured in a sheet material. In addition, this embodiment may have the extensions 100 and 102 secured together by a rivet 152 in addition to the crimping thereof. The clamp 154, for securing the abrasive material, is varied in shape from that shown in FIG. 5.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. In a soapstone sharpener for providing a fine marking edge on the stone, said sharpener comprising:

an elongated member having facing legs forming a V-shaped cross section, abrasive material secured on inner faces of the legs forming the V to form inner abrading surfaces of V-shaped cross section, said elongated member having extensions on said legs at one end thereof in the elongated direction, said extensions being in proximate relationship, means associated with said member for attachment to carrying means, and clip means being positioned within said extensions and extending over one end of said abrasive material to secure it in place, whereby a soapstone may be rubbed on said abrasive material within the V to form the soapstone to be complementary to the V and to have a fine marking edge.

2. In a soapstone sharpener for providing a fine marking edge on the stone, said sharpener comprising:

a single elongated member having continuous facing legs joined at their inner ends to form a V-shaped cross section, the inner ends of the joined legs forming the pointed end of the V and the outer ends of the legs being spaced and free, and abrasive material secured on inner faces of the legs forming the V to form inner abrading surfaces of V-shaped cross section, whereby a soapstone may be rubbed on said abrasive material within the V to form the soapstone to be complementary to the V and to have a fine marking edge, said elongated member has extensions on said legs at one end thereof in the elongated direction, said extensions being in proximate relationship, means associated with said member for attachment to carrying means.

3. In a soapstone sharpener for providing a fine marking edge on the stone, said sharpener comprising:

a single elongated member having continuous facing legs joined at their inner ends to form a V-shaped cross section, the inner ends of the joined legs forming the pointed end of the V and the outer ends of the legs being spaced and free, the inner ends of the legs terminating externally in the point of the V, and abrasive material secured on inner faces of the legs forming the V to form inner abrading surfaces of V-shaped cross section, whereby a soapstone may be rubbed on said abrasive material within the V to form the soapstone to be complementary to the V and to have a fine marking edge, and a pair of spaced spring clips extending transversely to the elongated direction and extending downwardly and outwardly from one of the free ends of one of the legs, each clip being biased toward the outer surface of the leg for attachment on sheet material between the clips and the leg.

4. In a soapstone sharpener for providing a fine marking edge on the stone, said sharpener comprising:

a single elongated member having continuous facing legs joined at their inner ends to form a V-shaped cross section, the inner ends of the joined legs forming the pointed end of the V and the outer ends of the legs being spaced and free, the inner ends of the legs terminating externally in the point of the V, and abrasive material secured on inner faces of the legs forming the V to form inner abrading surfaces of V-shaped cross section, whereby a soapstone may be rubbed on said abrasive material within the V to form the soapstone to be complementary to the V and to have a fine marking edge, and one of said legs having tabs at its ends extending in the elongated direction, said tabs being securable to a member for carrying said sharpener, said tabs are connected to said leg by respective bends at the leg ends, said bends being away from the plane of the leg and then toward said plane to position said tabs in the plane of said leg.

5. The invention according to claim 4 in which:

said abrasive material is in sheet form, and returning edge portions of said member extending over said abrasive material so as to secure it on said inner faces.

6. The invention according to claim 4 in which:

one of said legs has a spring clip on the exterior thereof for attachment to sheet material.

* * * * *